US010014627B2

(12) United States Patent
Toh et al.

(10) Patent No.: US 10,014,627 B2
(45) Date of Patent: Jul. 3, 2018

(54) ELECTRICAL CONNECTOR WITH UNLOCKING SLEEVE

(71) Applicant: Volex plc, London (GB)

(72) Inventors: Mui Lian Jessica Toh, Singapore (SG); Boon Leng Lim, Singapore (SG)

(73) Assignee: VOLEX PLC, Richmond (GB)

( * ) Notice: Subject to any disclaimer, the term of this patent is extended or adjusted under 35 U.S.C. 154(b) by 0 days.

(21) Appl. No.: 15/505,059

(22) PCT Filed: Aug. 20, 2015

(86) PCT No.: PCT/US2015/046151

§ 371 (c)(1),
(2) Date: Feb. 17, 2017

(87) PCT Pub. No.: WO2016/029042

PCT Pub. Date: Feb. 25, 2016

(65) Prior Publication Data

US 2017/0279221 A1 Sep. 28, 2017

Related U.S. Application Data

(60) Provisional application No. 62/039,850, filed on Aug. 20, 2014.

(51) Int. Cl.
*H01R 13/627* (2006.01)
*H01R 13/428* (2006.01)
(Continued)

(52) U.S. Cl.
CPC ..... *H01R 13/6272* (2013.01); *H01R 13/428* (2013.01); *H01R 13/6335* (2013.01); *H01R 24/30* (2013.01)

(58) Field of Classification Search
CPC ..... H01R 13/6271; H01R 13/6275; H01R 13/6335
(Continued)

(56) References Cited

U.S. PATENT DOCUMENTS 6,863,556 B2 * 3/2005 Viklund ..... H01R 13/6272 439/354
7,052,186 B1 5/2006 Bates
(Continued)

FOREIGN PATENT DOCUMENTS

JP H04-012275 U 1/1992

OTHER PUBLICATIONS

International Patent Application No. PCT/US2015/046151; Int'l Search Report and the Written Opinion; dated Nov. 24, 2015; 16 pages.

*Primary Examiner* — Hae Moon Hyeon
(74) *Attorney, Agent, or Firm* — Baker & Hostetler LLP

(57) ABSTRACT

An assembly comprises a connector and a sleeve. The connector includes a resilient locking member movable between an outwardly disposed locked position and an inwardly disposed unlocked position. The resilient locking member includes a button portion and a locking projection. A sleeve includes an aperture capable of engaging with the button portion of the resilient locking member. The sleeve is capable of sliding along the body of the connector and pushing down the button portion to unlock the resilient locking member so as to disengage the connector from its receptacle. The assembly further comprises a pair of stoppers provided on the sleeve and a pair of grooves provided on the connector. The pair of stoppers is engagable with the corresponding pair of grooves so that the connector is pulled out from the receptacle when a user continues to pull the sleeve backward after unlocking the resilient locking member.

20 Claims, 10 Drawing Sheets

(51) Int. Cl.
*H01R 13/633* (2006.01)
*H01R 24/30* (2011.01)

(58) Field of Classification Search
USPC ..... 439/352, 483, 347
See application file for complete search history.

(56) References Cited

U.S. PATENT DOCUMENTS 7,297,013 B2 * 11/2007 Caveney ..... H01R 13/6272 439/352
7,309,250 B2 * 12/2007 Reed ..... H01R 13/6275 439/352
7,465,180 B2 * 12/2008 Kusuda ..... H01R 13/6272 439/344
7,967,629 B1 * 6/2011 Liu ..... H01R 13/6272 439/354
8,267,712 B2 * 9/2012 Huang ..... H01R 43/26 439/344
8,632,352 B2 * 1/2014 Wagner ..... H01R 13/5812 439/352
8,979,569 B2 * 3/2015 Aekins ..... H01R 13/633 439/352
9,570,860 B1 * 2/2017 Chien ..... H01R 13/6582
9,761,998 B2 * 9/2017 De Dios Martin ..... H01R 13/6335
2004/0110406 A1 6/2004 Phillips et al.
2005/0064758 A1 3/2005 Li et al.
2009/0275228 A1 * 11/2009 Henry ..... H01R 13/6272 439/352
2010/0087084 A1 * 4/2010 George ..... H01R 13/6275 439/352
2010/0151720 A1 6/2010 Lin
2011/0124216 A1 5/2011 Wilson et al.

* cited by examiner

ELECTRICAL CONNECTOR WITH UNLOCKING SLEEVE

CROSS REFERENCE TO RELATED APPLICATIONS

This application is a National Stage Application filed under 35 U.S.C. § 371 of International Application No. PCT/US2015/046,151, filed Aug. 20, 2015, which claims benefit under 35 U.S.C. § 119(e) of Provisional U.S. patent application Ser. No. 62/039,850, filed Aug. 20, 2014. The contents of both applications are incorporated herein by reference in their entirety.

TECHNICAL FIELD

The present disclosure relates to an assembly comprising a connector including a resilient locking member and a sleeve capable of unlocking the resilient locking member, and to a sleeve and a connector for use with such an assembly.

SUMMARY

In accordance with an aspect of the present disclosure, there is provided an assembly which comprises a connector including a resilient locking member movable between an outwardly disposed locked position and an inwardly disposed unlocked position wherein the resilient locking member including a button portion and a locking projection, and a sleeve including an aperture capable of engaging with the button portion of the resilient locking member. The sleeve is capable of sliding along the body of the connector and pushing down the button portion to unlock the resilient locking member so as to disengage the connecter from its receptacle. The assembly further comprises one or more stoppers provided on the sleeve and one or more grooves provided on the connector, wherein the stoppers are engagable with the corresponding grooves so that the connector is pulled out from its receptacle when a user continues to pull the sleeve backward after unlocking the resilient locking member.

In accordance with a second aspect of the present disclosure, there is provided a sleeve which comprises an aperture capable of engaging with a button portion of a resilient locking member provided on a connector and a pair of stoppers capable of engaging with a pair of grooves provided on the connector. While a user pulls the sleeve backward, the button portion is pushed down so as to unlock the resilient locking member and disengage the connector from its receptacle. Each of the stoppers includes a generally flat surface serving to engage with a wall of the corresponding groove so that the connector is pulled out from its receptacle when a user continues to pull the sleeve backward after unlocking the resilient locking member.

In accordance with a third aspect of the present disclosure, there is provided a connector which comprises a resilient locking member movable between an outwardly disposed locked position and an inwardly disposed unlocked position wherein the resilient locking member further include a button portion and a locking projection, and at least one groove positioned on the two outer surfaces of the connector. The button portion is engagable with an aperture provided on a sleeve being capable of sliding along the body of the connector so as to unlock the resilient locking member and disengage the connector from its receptacle. Each of the grooves is engagable with a corresponding stopper provided on the sleeve so that the connector is pulled out from its receptacle when a user continues to pull the sleeve backward after unlocking the resilient locking member.

BRIEF DESCRIPTION OF THE DRAWINGS

Embodiments of the present disclosure will be described more fully hereinafter with reference to the accompanying drawings, in which.

DETAILED DESCRIPTION OF ILLUSTRATIVE EMBODIMENTS

Figure 1B:
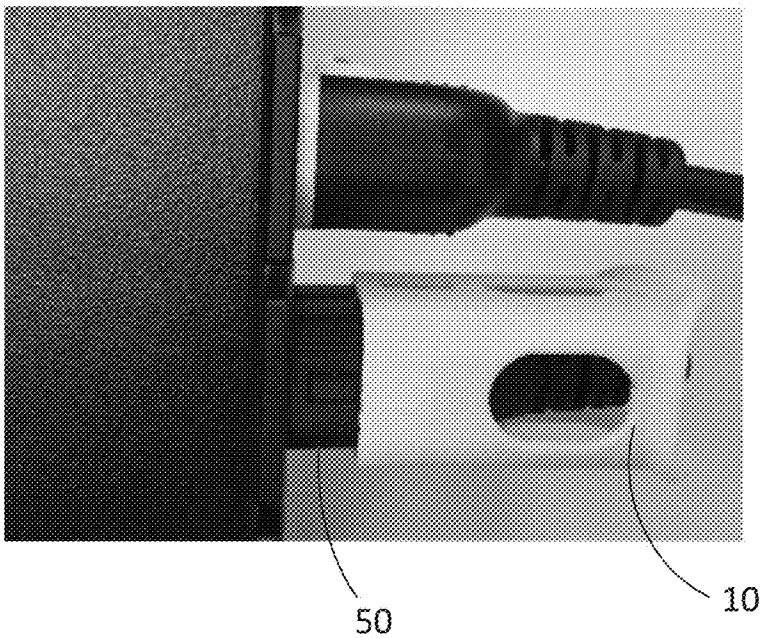
FIGS. 1A-1D illustrate an example sleeve used on a connecter engaging with one of a plurality of closely spaced receptacles.
Figure 1A:
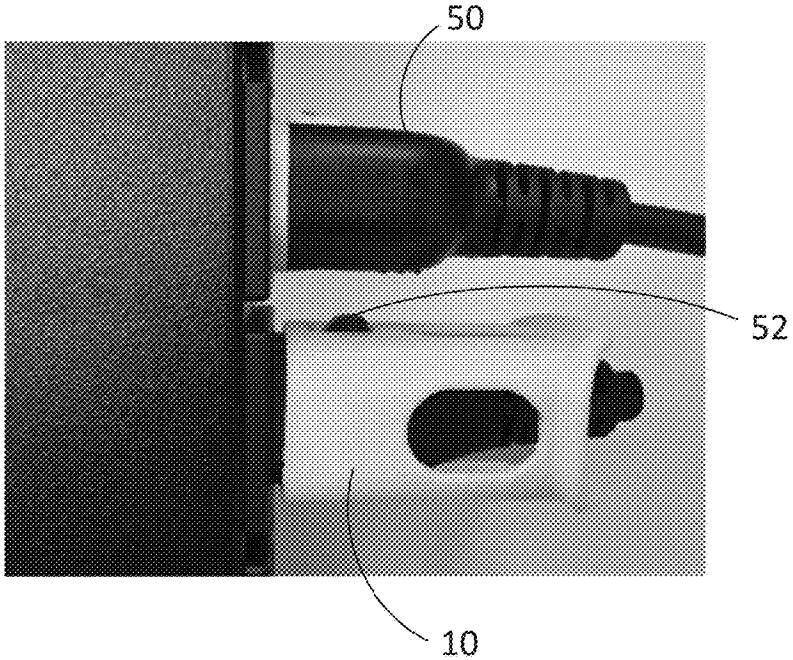

While embodiments of an electrical power connector and a sleeve are illustrated for convenience and simplicity in the drawings and described herein, it is to be understood that the present disclosure is not limited to the described electrical power connectors and the sleeve could equally apply to any type of connector which comprises a resilient locking member.

In a Power Distribution Unit (PDU), there are multiple receptacles, such as outlets, arranged side-by-side to distribute electric power, for example, to racks of computer and networking equipment located within a data center. Current V-lock connector systems provide enhanced secure attachment to a receptacle with a positive lock to prevent the accidental dislodging of a plug connector from its receptacle. However, with decreased connector receptacle spacing, users can face finger access issues and face difficulties in pressing the push button to release the positive lock from the receptacle.

FIGS. 1A-1D illustrate an example sleeve used on a connecter engaging with one of a plurality of closely spaced receptacles. As shown in FIGS. 1A-1D, the present disclosure aims to solve the above problem with the introduction of a sleeve 10 which may slide along the body of a connector 50, whereby the slide action may translate into pressing the button portion 52 of the connector 50, thus unlocking the positive lock so that the connector 50 can be pulled out from receptacle 80. Unlocking the positive lock and pulling out the connector 50 can be accomplished with a single action by just pulling the sleeve 10.

Figure 1D:
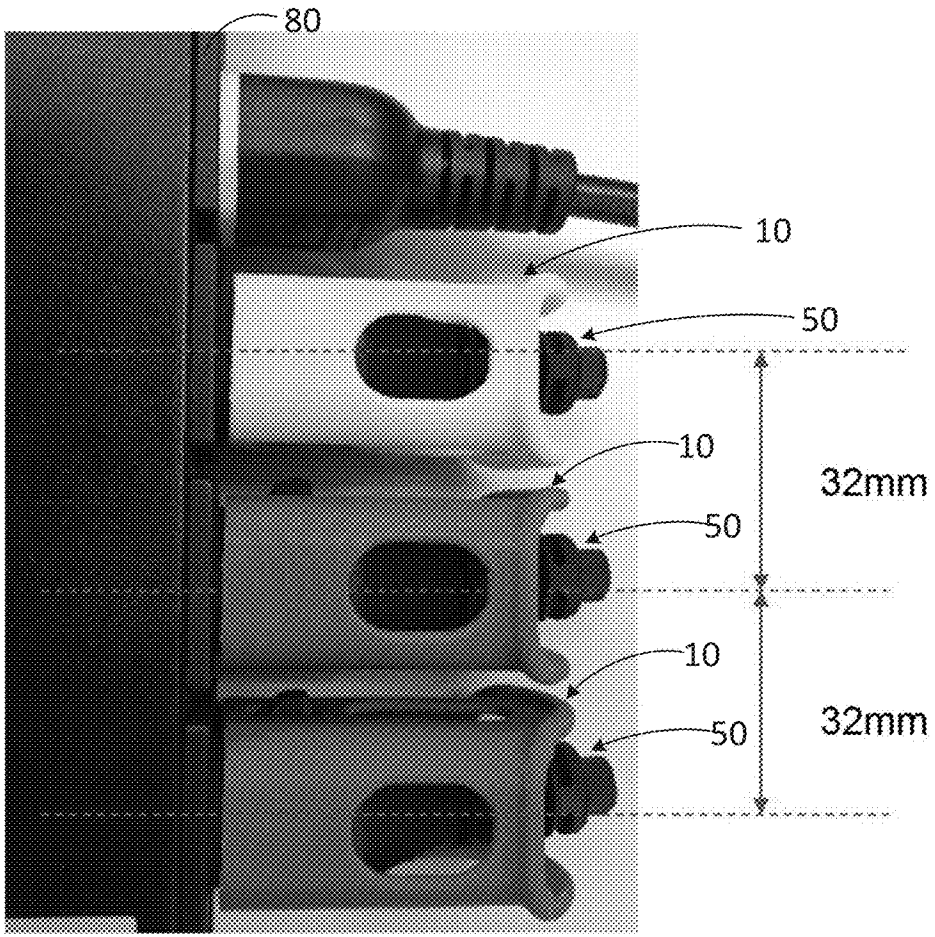
Figure 1C:
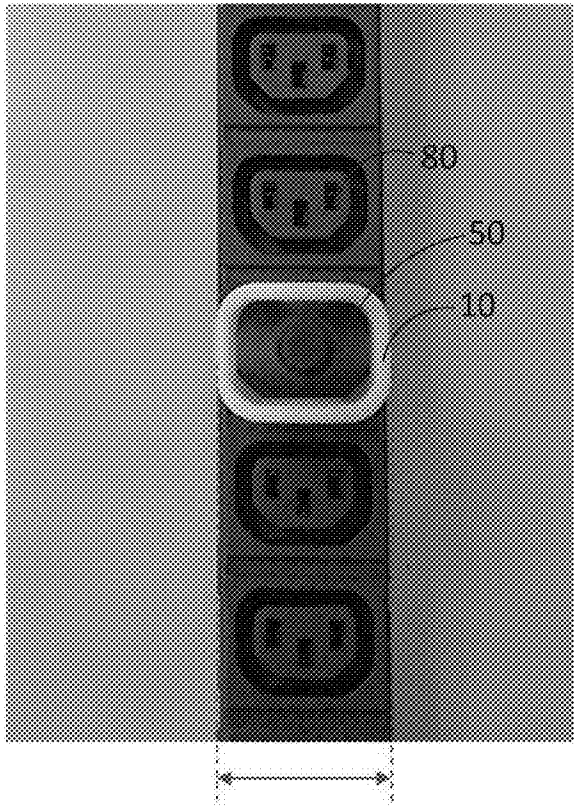

The introduction of the sleeve 10 enables the connector 50 with the positive lock to be easily pulled out from one of a plurality of closely spaced receptacles 80. In other words, the use of the sleeve 10 allows the plurality of receptacles 80 to be arranged more closely. By way of example and without limitation, as illustrated in FIG. 1D, the distance between the centers of any two receptacles 80 may be 32 mm. The sleeve 10 can be colorful for identification purposes or aesthetic features for the PDU.

Figure 2A:
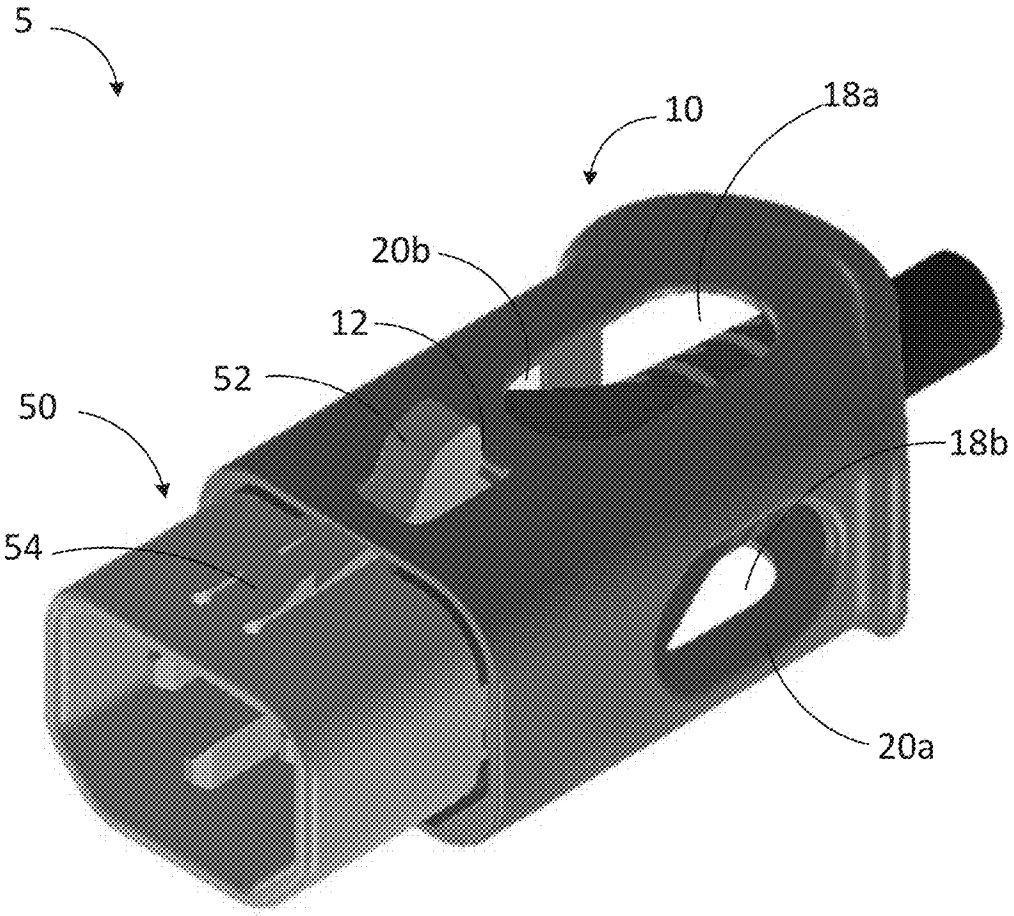
FIG. 2A is a perspective view of an example assembly.

FIG. 2A is a perspective view of an example assembly. The assembly 5 comprises the sleeve 10 and the connector 50. The sleeve 10 may be configured such that it is capable of engaging with the button portion 52 of the connector 50 and sliding along the body of the connector 50. The sleeve 10 may have any shape as long as it is able to engage with the button portion 52 and slide along the body of the connector 50. The sleeve 10 may be made of any suitable insulation materials, such as plastics.

Figures 2B, 2C:
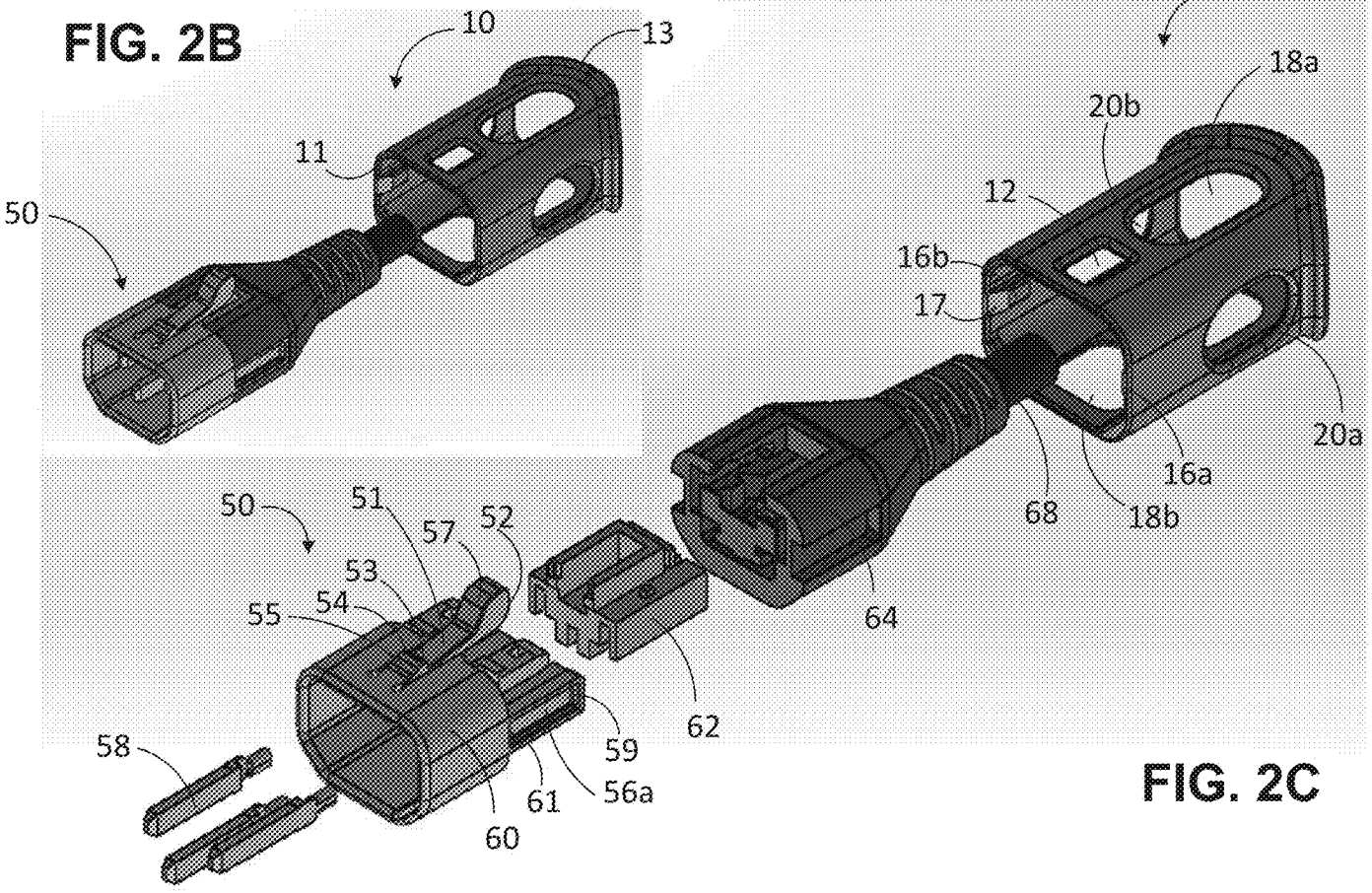
FIG. 2B-2C are exploded perspective views of an example assembly.

FIG. 2B-2C are exploded perspective views of an example assembly. FIGS. 2B-2C illustrate the structures of the sleeve 10 and the connector 50. By way of example and without limitation, as shown in FIGS. 2B and 2C, the sleeve 10 may be an approximately hollow rectangular cuboid shaped. The front end surface 11 of the sleeve 10 may form an approximate rectangle. The back end surface 13 of the sleeve 10 may form any shape different from the shape of the front end surface 11, such as a 3D curve. The shape difference between the front end surface 11 and the back end surface 13 of the sleeve 10 enables a user to easily recognize them, thereby guaranteeing that the sleeve 10 can be assembled onto the connector 50 in the desired direction.

As illustrated in FIGS. 2B-2C, the sleeve 10 comprises an aperture 12, a pair of stoppers 16*a* and 16*b*, a pair of top-bottom finger access areas 18*a* and 18*b*, and a pair of left-right finger access areas 20*a* and 20*b*. The aperture 12 may be configured and disposed such that it is capable of receiving the button portion 52 of the connector 50. The aperture 12 may be positioned adjacent to the front end of the top surface of the sleeve 10. The aperture 12 may be rectangular or have any other shape suitable for receiving the button portion 52. When a user pulls the sleeve 10 backward, the button portion 52 is pushed down to unlock a resilient locking member so as to disengage the connecter 50 from its receptacle.

The pair of stoppers 16*a* and 16*b* may be configured and disposed such that it is capable of sliding within a pair of grooves 56*a* and 56*b* provided on the two outer side surfaces of the connector 50. The pair of stoppers 16*a* and 16*b* may be symmetrically positioned adjacent to the front end of the two inner side surfaces of the sleeve 10. Each of stoppers 16*a* and 16*b* may be shaped so as to include a first ramp 17 and a generally flat surface 19. The first ramp 17 may serve to urge the sleeve 10 to assemble onto the connector 50. The flat surface 19 may serve to engage with the back wall of the corresponding groove 56*a* or 56*b* so that the connector 50 can be pulled out from its receptacle when a user continues to pull the sleeve 10 backward after unlocking the resilient locking member 51. Alternate embodiments may have different numbers of grooves and corresponding stoppers. For example, a single groove and stopper may work well for some plug shapes, or a third groove and stopper might be added to the bottom of assembly 5 opposite resilient locking member 51.

Figure 4A:
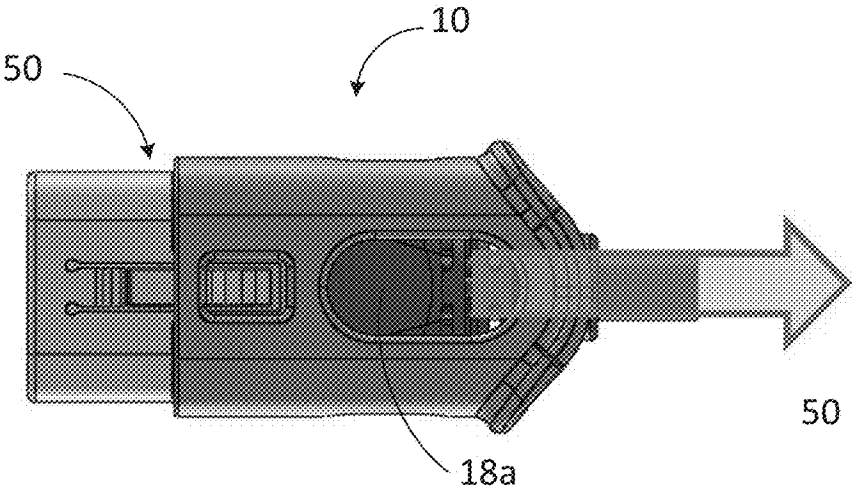
FIG. 4A illustrates an example connector disengaged from a receptacle by pulling from top and bottom sides of a sleeve.
Figure 4B:
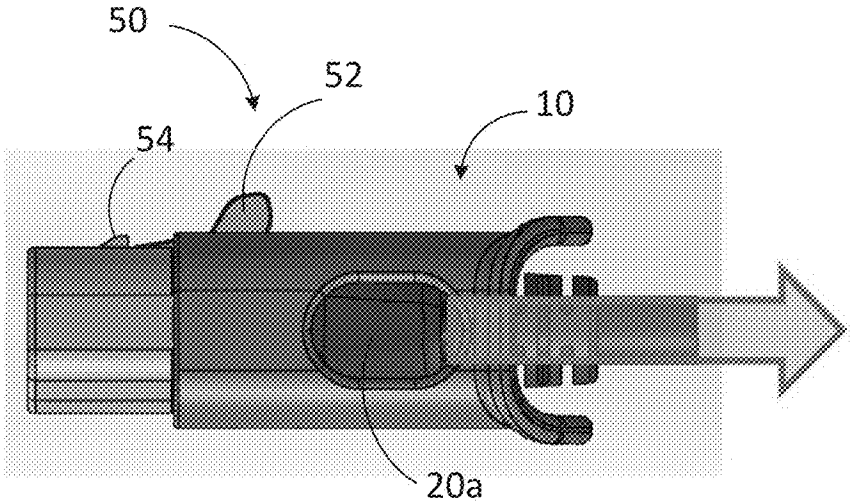
FIG. 4B illustrates an example connector disengaged from a receptacle by pulling from left and right sides of a sleeve.

A pair of finger access areas 18*a* and 18*b* may be approximately symmetrically formed on the top and bottom surfaces of the sleeve 10, respectively. Another pair of finger access areas 20*a* and 20*b* may be approximately symmetrically formed on the left and right side surfaces of the sleeve 10, respectively. As shown more particularly in FIGS. 4A and 4B, the arrangement of the two pairs of finger accesses enables a user to pull the sleeve 10 along the body of the connector 50 either by holding its top and bottom surfaces or by holding its two side surfaces. FIG. 4A illustrates an example connector disengaged from a receptacle by pulling from top and bottom sides of a sleeve. FIG. 4B illustrates an example connector disengaged from a receptacle by pulling from left and right sides of a sleeve. Each of the finger access areas may be an opening formed on a corresponding surface of the sleeve 10. The finger access areas can also be any other member suitable for a user's fingers to hold the sleeve 10 and pull it along the body of the connector 50.

As illustrated in FIGS. 2B-2C, the connector 50 includes a resilient locking member 51, a set of electrical terminals 58, an outer housing 60, and an inner housing 62, an overmold 64, and a power cord 68. The locking member 51 may serve to lock the connector 50 relative to a receptacle, and to permit selective unlocking of the connector 50 from the receptacle, thereby allowing withdrawal of the connector 50 from the receptacle. The locking member 51 further comprises the button portion 52 and a locking projection 54. The button portion 52 and the locking projection 54 may be resiliently movable inwardly of the connector 50 by application of a force to the button portion 52. The button portion 52 may be shaped to include a second ramp 57 which serves to urge the sleeve 10 to slide backward along the connector 50.

Figure 6B:
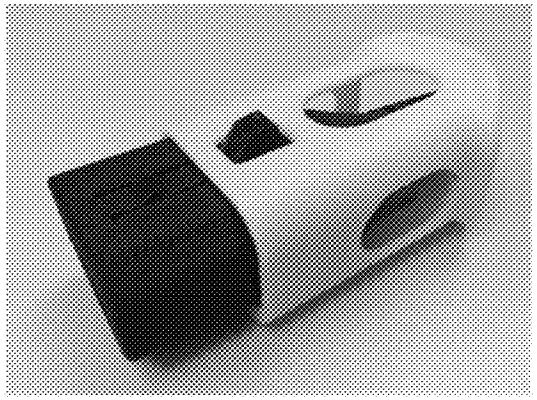
FIG. 6B is a perspective view of an example sleeve engaging with a connector.
Figure 6C:
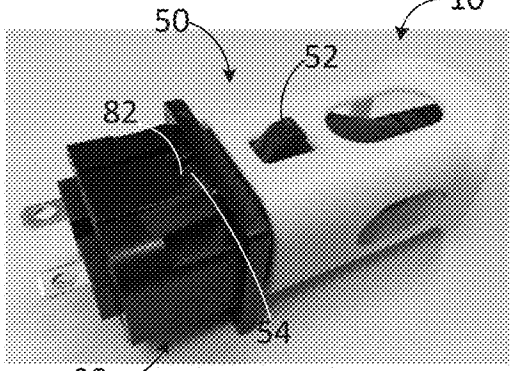
FIG. 6C is a perspective view of an example assembly engaging with a connector receptacle.

The locking projection 54 may be shaped so as to include a generally flat surface 53 and a third ramp 55. The flat surface 53 serves to engage securely with a wall of a recess formed in the receptacle in order to prevent unintentional disengagement of the connector 50 from the receptacle. The third ramp 55 serves to urge the button portion 52 and the locking projection 54 of the connector 50 to move inwardly of the connector 50 during insertion of the connector 50 into the receptacle. The locking projection 54 may have any other suitable alternative structures. For instance, an alternative shaped locking projection 54 and the corresponding recess formed in the receptacle may be each provided with a stepped portion which serves to provide two locking positions. Alternatively, the locking projection 54 may engage with a cut-out slot 82 formed in the receptacle 80 to prevent unintentional disengagement of the connector 50 from the receptacle 80, as illustrated in FIG. 6C.

The set of terminals 58 may be engageable with a receptacle so as to receive or supply electrical power. The terminals 58 may be in electrical connection with the power cord 68. The terminals 58 may be provided within the inner housing 62. The outer housing 60 may be coupled to the inner housing 62 and may be configured to hold the set of electrical terminals 58. The overmold 64 may be formed over the inner housing 62 using a conventional over molding process.

Figure 5:
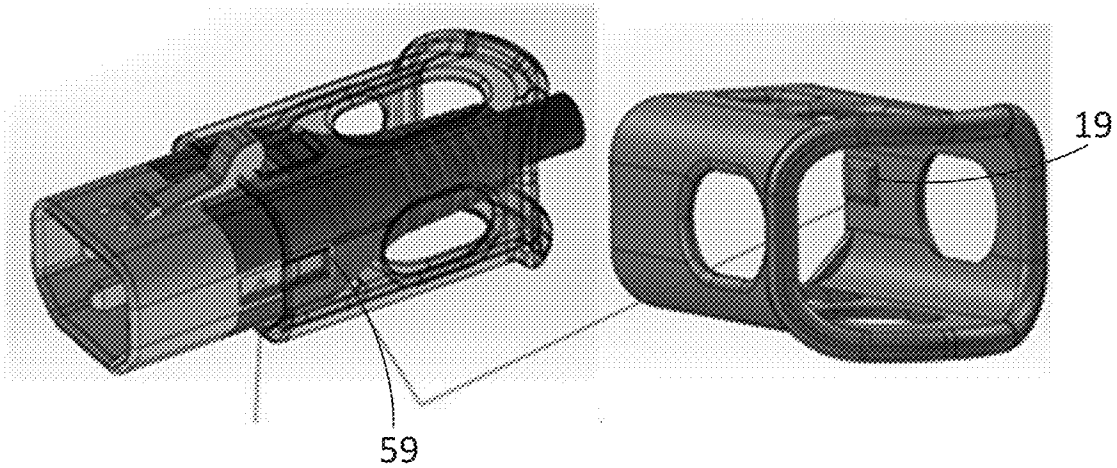
FIG. 5 illustrates an example stopper engaging with a wall of a corresponding slide groove.

As mentioned above, the pair of grooves 56*a* and 56*b* may be provided on the left and right side surfaces of the outer housing 60, respectively. The groove 56*a* or 56*b* may have any shape as long as it is able to receive the corresponding stopper 16*a* or 16*b* and allow the corresponding stopper 16*a* or 16*b* to freely slide within it. By way of example and without limitation, the grooves 56*a* and 56*b* may be rectangular. The distance between the front side wall 61 and the back side wall 59 of the grooves 56*a* or 56*b* may be long enough to allow the corresponding stopper 16*a* or 16*b* to slide backward so as to unlock the locking member and disengage the connector 50 from its receptacle. As shown more particularly in FIG. 5, the flat surface 19 of the stoppers 16*a* or 16*b* may engage with the back side wall 59 of the corresponding groove 56*a* or 56*b* so that the connector 50 can be pulled out from its receptacle when a user continues to pull the sleeve 10 backward after the connector 50 is disengaged from its receptacle.

Figure 3B:
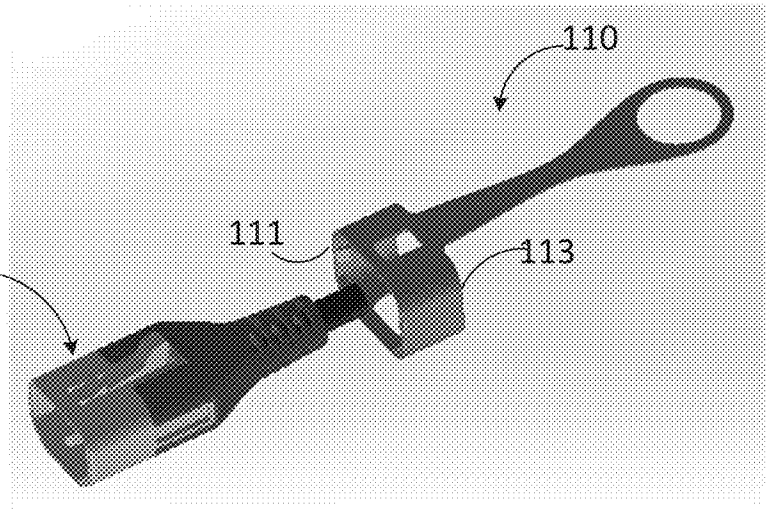
FIG. 3B-3C are exploded perspective views of an second example assembly.
Figure 3A:
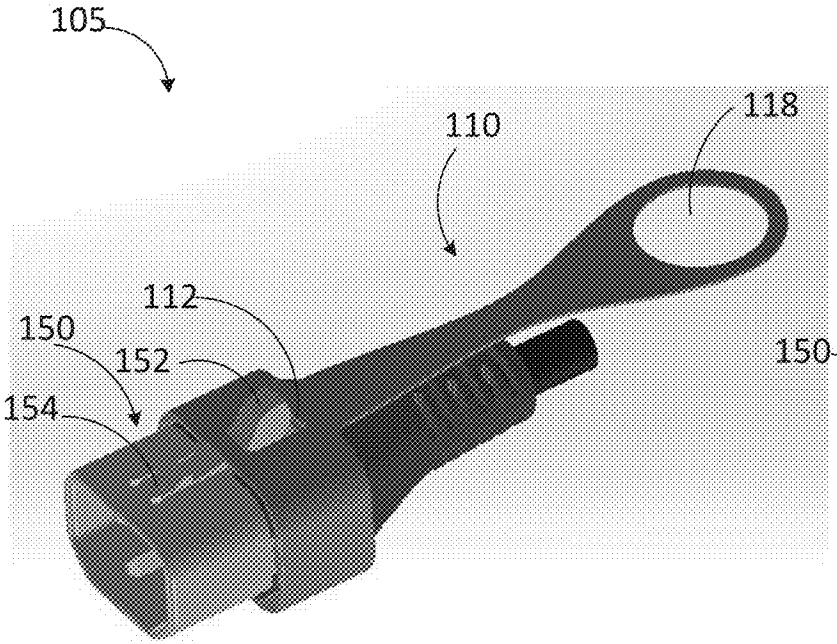
FIG. 3A is a perspective view of a second example assembly.

FIG. 3A is a perspective view of a second example assembly. The assembly 105 comprises the sleeve 110 and the connector 150. Assembly 105 is substantially similar to assembly 5 of FIGS. 2A-2C with sleeve 10 replaced by sleeve 110, where sleeve 110 has an alternate back end surface and an alternate finger access area. The sleeve 110 may be configured such that it is capable of engaging with the button portion 152 of the connector 150 and sliding along the body of the connector 150. The sleeve 110 may have any shape as long as it is able to engage with the button portion 152 and slide along the body of the connector 150. The sleeve 110 may be made of any suitable insulation materials, such as plastics.

Figure 3C:
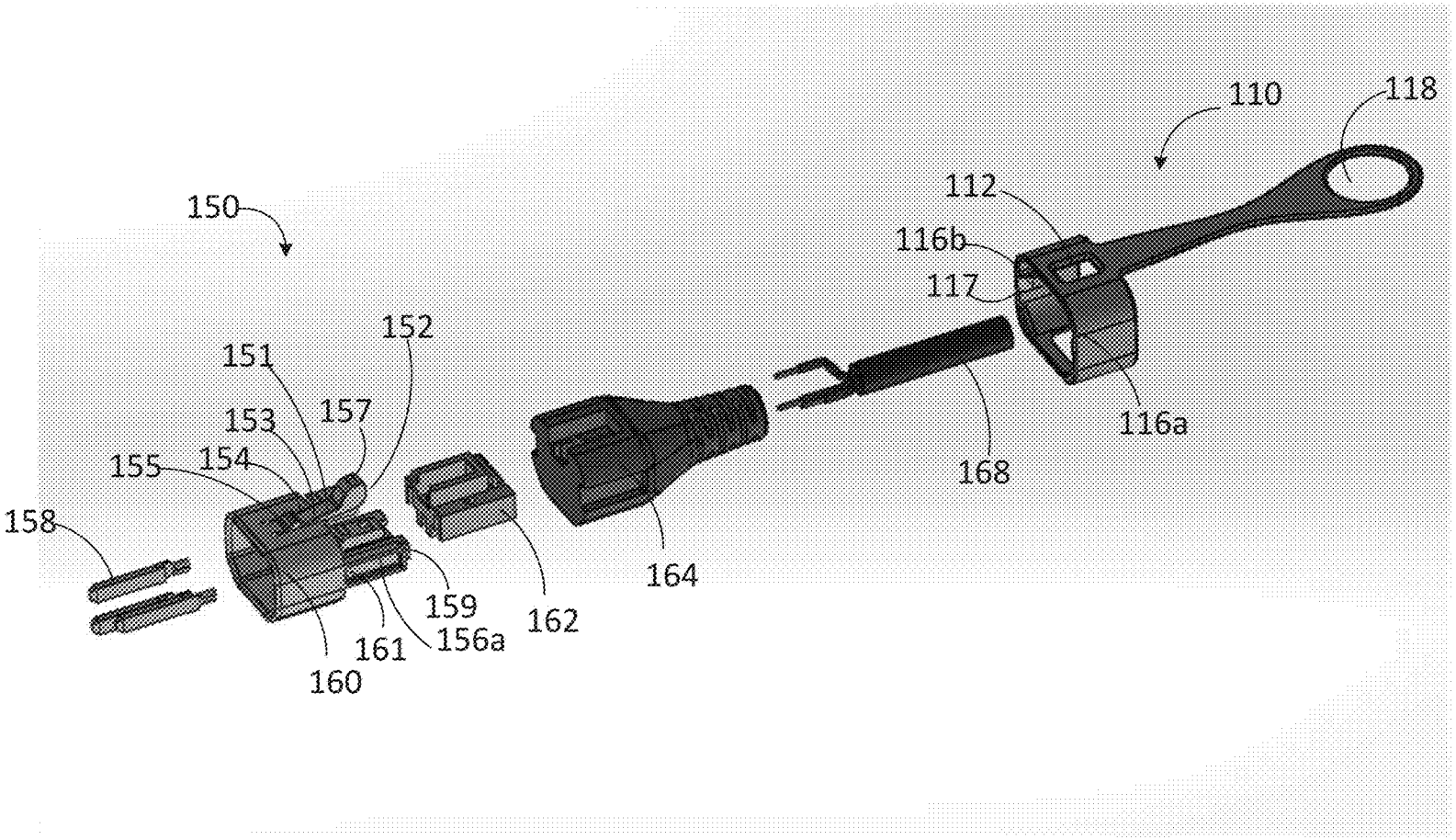

FIG. 3B-3C are exploded perspective views of a second example assembly. FIGS. 3B-3C illustrate the structures of the sleeve 110 and the connector 150. By way of example and without limitation, as shown in FIGS. 3B and 3C, the sleeve 110 may be an approximately hollow rectangular cuboid shaped. The front end surface 111 of the sleeve 110 may form an approximate rectangle. The back end surface 113 of the sleeve 110 may form any shape different from the shape of the front end surface 111, such as a 3D curve. The shape difference between the front end surface 111 and the back end surface 113 of the sleeve 110 enables a user to easily recognize them, thereby guaranteeing that the sleeve 110 can be assembled onto the connector 150 in a correct direction.

As illustrated in FIGS. 3B-3C, the sleeve 110 comprises an aperture 112, a pair of stoppers 116*a* and 116*b*, and a finger access area 118. The aperture 112 may be configured and disposed such that it is capable of receiving the button portion 152 of the connector 150. The aperture 112 may be positioned adjacent to the front end of the top surface of the sleeve 110. The aperture 112 may be rectangular or have any other shape suitable for receiving the button portion 152. When a user pulls the sleeve 110 backward, the button portion 152 is pushed down to unlock a resilient locking member so as to disengage the connecter 150 from its receptacle.

The pair of stoppers 116*a* and 116*b* may be configured and disposed such that it is capable of sliding within a pair of grooves (including groove 156*a*) provided on the two outer side surfaces of the connector 150. The pair of stoppers 116*a* and 116*b* may be symmetrically positioned adjacent to the front end of the two inner side surfaces of the sleeve 110. Each of stoppers 116*a* and 116*b* may be shaped so as to include a first ramp 117 and a generally flat surface 119. The first ramp 117 may serve to urge the sleeve 110 to assemble onto the connector 150. A flat surface on the stoppers 116*a* and 116*b* may serve to engage with the back wall of the corresponding groove (such as groove 156*a* on connector 150) so that the connector 150 can be pulled out from its receptacle when a user continues to pull the sleeve 110 backward after unlocking the resilient locking member 151.

Unlike sleeve 10 of FIG. 2A-2C, sleeve 110 of FIGS. 3A-3C has a single finger access area 118. In the embodiment of FIG. 3C, the finger access area 118 is at the end of an elongated tab extending from the back end surface 113 of sleeve 110. The elongated tab having finger access area 118 may or may not be flexible to better enable pulling the sleeve away from a receptacle. By extending the finger access area 118 further away from back end surface 113, a user's fingers need not reach any sides of the connector 150 to be able to pull the sleeve 110 away from a receptacle.

As illustrated in FIGS. 3B-3C, the connector 150 includes a resilient locking member 151, a set of electrical terminals 158, an outer housing 160, an inner housing 162, an overmold 164, and a power cord 168. The locking member 151 may serve to lock the connector 150 relative to a receptacle, and to permit selective unlocking of the connector 150 from the receptacle, thereby allowing withdrawal of the connector 150 from the receptacle. The locking member 151 further comprises the button portion 152 and a locking projection 154. The button portion 152 and the locking projection 154 may be resiliently movable inwardly of the connector 150 by application of a force to the button portion 152. The button portion 152 may be shaped to include a second ramp 157 which serves to urge the sleeve 10 to slide backward along the connector 150.

The locking projection 154 may be shaped so as to include a generally flat surface 153 and a third ramp 155. The flat surface 153 serves to engage securely with a wall of a recess formed in the receptacle in order to prevent unintentional disengagement of the connector 150 from the receptacle. The third ramp 155 serves to urge the button portion 152 and the locking projection 154 of the connector 150 to move inwardly of the connector 150 during insertion of the connector 150 into the receptacle.

The set of terminals 158 may be engageable with a receptacle so as to receive or supply electrical power. The terminals 158 may be in electrical connection with the power cord 168. The terminals 158 may be provided within the inner housing 162. The outer housing 160 may be coupled to the inner housing 162 and may be configured to hold the set of electrical terminals 158. The overmold 164 may be formed over the inner housing 162 using a conventional over molding process.

As mentioned above, a pair of grooves that includes 156*a* may be provided on the left and right side surfaces of the outer housing 160, respectively. The groove 156*a* may have any shape as long as it is able to receive the corresponding stopper 116*a* or 116*b* and allow the corresponding stopper 116*a* or 116*b* to freely slide within it. By way of example and without limitation, the groove 156*a* may be rectangular. The distance between the front side wall 161 and the back side wall 159 of the groove 156*a* may be long enough to allow the corresponding stopper 116*a* or 116*b* to slide backward so as to unlock the locking member and disengage the connector 150 from its receptacle. As shown more particularly in FIG. 5 for assembly 5, a flat surface similar to 19 of the stoppers 116*a* or 116*b* may engage with the back side wall 159 of the corresponding groove 156*a* so that the connector 150 can be pulled out from its receptacle when a user continues to pull the sleeve 110 backward after the connector 150 is disengaged from its receptacle.

Figure 6A:
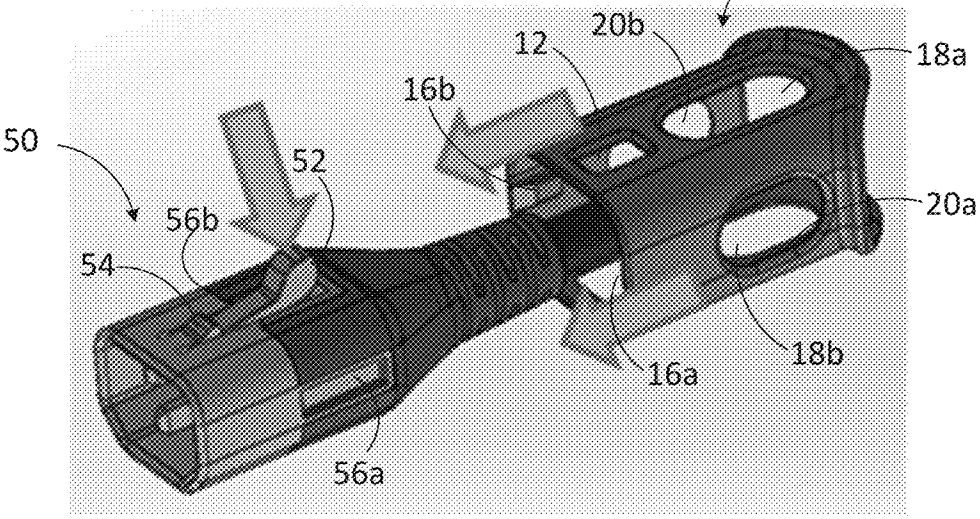
FIG. 6A illustrates an example process for assembling a sleeve onto a connector.

FIG. 6A illustrates the process of assembling the sleeve 10 onto the connector 50. The assembling method includes the steps (1) pressing down the button portion 52 of the locking member 51 provided on the connector 50; (2) sliding the sleeve 10 from the back of the connector 50 until the stoppers 16*a* and 16*b* snap into the corresponding grooves 56*a* and 56*b* of the connector 50; (3) engaging the sleeve 10 with the connector 50 when the button portion 52 of the connector 50 is received within the aperture 12 of the sleeve 10, as shown in FIG. 6B.

FIG. 6C illustrates a perspective view of the locking member 51 of the connector 50 engaging with the sleeve 10 and the receptacle 80. As mentioned above, the locking projection 54 of the locking member 51 may lock into the cut-out slot 82 of the receptacle 80 in order to secure the engagement between the connector 50 and the receptacle 80 and prevent unintentional disengagement of the connector 50 from the receptacle 80. The button portion 52 of the locking member 51 may engage with the aperture 12 of the sleeve 10.

Figure 7B:
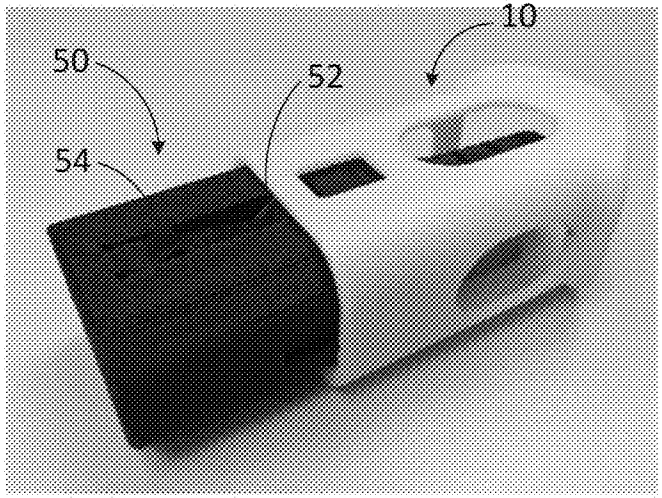
FIGS. 7A-7B illustrate an example process for disengaging a connector from a receptacle by pulling a sleeve.
Figure 7A:
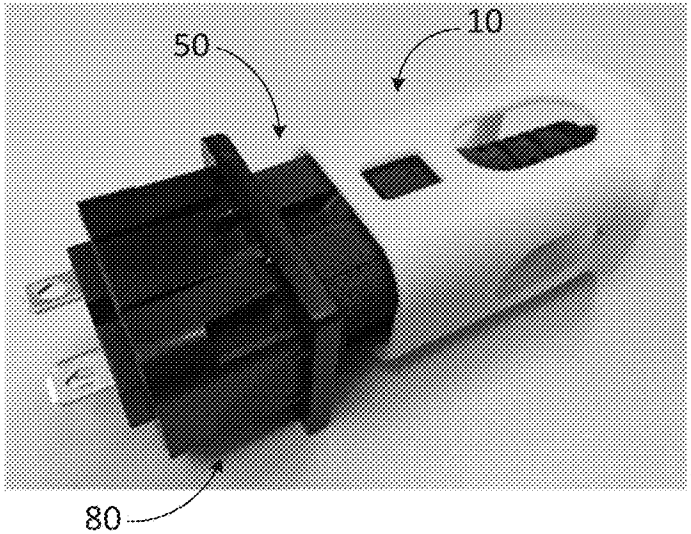

FIGS. 7A and 7B illustrate the process of disengaging the connector 50 from the receptacle 80 by pulling the sleeve 10 backward. When a user pulls the sleeve 10 backward, an inwardly directed force is applied to the button portion 52, thereby pushing downward the button portion 52. Meanwhile, the locking projection 54 moves inwardly of the connector 50 and is out of engagement with the recess or the cut-out slot 54 of the receptacle 80, whereby the connector 50 is ready to be pulled out from the receptacle 80. Each of the stoppers 16*a* and 16*b* may then engage with the back wall 59 of the corresponding groove 56*a* or 56*b*. The engagement of the stopper 16*a* and 16*b* with the corresponding groove 56*a* and 56*b* enables the connector 50 to be pulled out from the receptacle 80 when a user continues to pull the sleeve 10 backward.

While certain embodiments have been described, these embodiments have been presented by way of example only, and are not intended to limit the scope of the inventions disclosed herein. Thus, nothing in the foregoing description is intended to imply that any particular feature, characteristic, or step is necessary or indispensable. Indeed, the present disclosure described herein may be embodied in a variety of other forms; furthermore, various omissions, substitutions, and changes in the form of the embodiments described herein may be made without departing from the spirit of the inventions disclosed herein. The accompanying claims and their equivalents are intended to cover such forms or modifications as would fall within the scope and spirit of certain of the inventions disclosed herein.

What is claimed:

1. An assembly, comprising:

a connector for a high electrical power receptacle comprising at least two electrical terminals for transferring high electrical power and a resilient locking member movable between an outwardly disposed locked position and an inwardly disposed unlocked position, wherein the resilient locking member includes a button portion and a locking projection, the locking projection spanning the width of the resilient locking member; and a sleeve comprising an aperture capable of engaging with the button portion of the resilient locking member;

wherein the sleeve capable of sliding along a body of the connector and pushing down the button portion to unlock the resilient locking member so as to disengage the connecter from the high electrical power receptacle.

2. The assembly of claim 1 wherein the button portion includes a ramp serving to urge the sleeve to slide backward.

3. The assembly of claim 1 wherein the connector further comprises one or more grooves formed on one or more outer side surfaces of the connector.

4. The assembly of claim 3 wherein the sleeve further comprises one or more stoppers positioned on one or more inner side surfaces of the sleeve, each of the stoppers being capable of sliding within a corresponding groove.

5. The assembly of claim 4 wherein each of the stoppers includes a generally flat surface serving to engage with a wall of the corresponding groove so that the connector is disengaged and pulled out from the high electrical power receptacle when a user continues to pull the sleeve backward after unlocking the resilient locking member.

6. The assembly of claim 1 wherein the sleeve further comprises at least one finger access area used by a user for pulling the sleeve.

7. The assembly of claim 6 wherein two pairs of finger access areas are positioned on top-bottom surfaces and left-right surfaces of the sleeve, respectively.

8. The assembly of claim 1 wherein a front end surface and back end surface of the sleeve have different shapes so as to guarantee that the sleeve is correctly assembled onto the connector.

9. A sleeve, comprising:

an aperture capable of engaging with a button portion of a resilient locking member provided on a connector for a high electrical power receptacle; and a pair of stoppers capable of engaging with a pair of grooves formed on the connector;

wherein the sleeve is capable of sliding along the connector and pushing the button portion down so as to unlocking the resilient locking member and disengage connecter from the high electrical power receptacle.

10. The sleeve of claim 9 wherein the aperture is positioned adjacent to a front end of a top surface of the sleeve.

11. The sleeve of claim 10 wherein the aperture is rectangular.

12. The sleeve of claim 9 wherein each of the stoppers includes a generally flat surface serving to engage with a wall of a corresponding groove so that the connector is disengaged and pulled out from the high electrical power receptacle when a user continues to pull the sleeve backward after unlocking the resilient locking member.

13. The sleeve of claim 12 wherein each of the stoppers further includes a ramp portion serving to urge the sleeve to assemble onto the connector.

14. The sleeve of claim 9, further comprising at least one finger access area configured to enable a user to pull the sleeve.

15. The sleeve of claim 14 wherein two pairs of finger access areas are positioned on top-bottom surfaces and left-right surfaces of the sleeve, respectively.

16. The sleeve of claim 9 wherein a front end surface and back end surface of the sleeve have different shapes so as to guarantee that the sleeve is correctly assembled onto the connector.

17. The sleeve of claim 9 wherein the sleeve is colorful.

18. A connector, comprising:

an outer housing configured for mating with a high electrical power receptacle;

at least two electrical terminals for transferring high electrical power;

a resilient locking member movable between an outwardly disposed locked position and an inwardly disposed unlocked position, wherein the resilient locking member includes a button portion and a locking projection, the locking projection spanning the width of the resilient locking member;

at least one groove formed on at least one outer surface of the outer housing and aligned along an axis defined by the direction along which the connector, when mated with the high electrical power receptacle, is removable from the high electrical power receptacle; and a wall at an end of the at least one groove, wherein the wall is configured for engaging with a stopper sliding along the length of the at least one groove.

19. The connector of claim 18 wherein the button portion is engagable with an aperture provided on a sleeve, wherein the sleeve is capable of pushing the button portion down and unlocking the resilient locking member when a user pulls the sleeve backward.

20. The connector of claim 19 wherein each of the grooves is engagable with a corresponding stopper positioned on the sleeve so that the connector is disengaged and pulled out from the high electrical power receptacle when a user continues to pull the sleeve backward after unlocking the resilient locking member.

* * * * *